US005285035A

United States Patent [19]

Williams et al.

[11] Patent Number: 5,285,035

[45] Date of Patent: Feb. 8, 1994

[54] DUST PROOF ELECTRICAL SWITCH

[75] Inventors: Ronald D. Williams, St. Charles; William D. Crow, Maryland Heights, both of Mo.

[73] Assignee: Emerson Electric Co., St. Louis, Mo.

[21] Appl. No.: 972,984

[22] Filed: Nov. 10, 1992

[51] Int. Cl.[5] ..... H01H 35/10; H01H 9/04

[52] U.S. Cl. ..... 200/80 R; 200/302.1

[58] Field of Search ..... 200/80 R, 80 A, 80 B, 200/302.1, 302.2, 302.3

[56] References Cited

U.S. PATENT DOCUMENTS

| | | | |
|---|---|---|---|
| 4,110,720 | 8/1978 | Smith | 337/319 |
| 4,414,443 | 11/1983 | Gehrt | 200/80 |
| 4,686,401 | 8/1987 | Gehrt | 310/68 |
| 4,834,173 | 7/1987 | Crow et al. | 200/80 |
| 4,922,066 | 5/1990 | Crow et al. | 200/80 |
| 4,927,988 | 5/1990 | Nolte | 200/80 R |

*Primary Examiner*—A. D. Pellinen
*Assistant Examiner*—Michael A. Friedhofer
*Attorney, Agent, or Firm*—Polster, Lieder, Woodruff & Lucchesi

[57] ABSTRACT

A dust proof electric switch is provided for use in a dynamoelectric machine employing a centrifugal acuator having a terminal board with a cup formed therein in which a fixed contact point and terminal are mounted. A pivotable switch arm having a contact point attached thereto is mounted to the arm and extends above and cantilevered across the terminal board so that pressure on the switch arm from the centrifugal acuator causes the contact points to touch thereby closing the circuit. An open ended, resilient, flexible boot is affixed to the cup and extends upward between the terminal board to snuggly abut the switch arm and completely enclose the contact points when they are touching and when they are apart thereby protecting the contact area from dust and debris as well as containing sparks within the boot. The terminal board contains stops which serve to maintain alignment of the switch arm.

14 Claims, 5 Drawing Sheets

DUST PROOF ELECTRICAL SWITCH

BACKGROUND OF THE INVENTION

This invention relates to switch assembly structure for electrical machinery and more particularly to an improved switch assembly which protects the contact points of the switch from external contaminants which can be utilized in a number of types of electrical machinery, for example, in a radial arm saw, in conjunction with conventional centrifugal actuators for dynamoelectric machines. While the invention is described in detail with respect to the saw application, those skilled in the art will recognize the wider applicability of this invention.

As is well known in the art, a number of dynamoelectric machines, for example, capacitor start and split phase induction motors, utilize a first winding combination for the "starting" condition of a motor operation, and a second winding combination for the "run" condition of a motor operation. These motors include a stator assembly and a rotor assembly, the rotor assembly including a shaft and the stator assembly including a plurality of windings. The selective energization of the windings is used to generate suitable forces for rotating the rotor assembly in both "start" and "run" conditions. As also known in the art, a centrifugal actuator mounted on the shaft is utilized to move a switch arm of a switch assembly mounted on a terminal board between a first position and a second position to cause selective electrical energization of the winding combinations.

These types of switch assemblies are known to the art. For example, U.S. Pat. No. 4,034,173 to Crow et al., discloses a starting switch assembly integrally formed with a terminal connection board which is adapted to be actuated by a conventional centrifugal actuator. U.S. Pat. No. 4,686,401 to Gehrt, et al., discloses a starting switch assembly integrally formed with a terminal connection board also designed to selectively engage and disengage contacts for electrical machinery such as the windings for dynamoelectric machines.

Generally, however, motor switches of the prior art have obvious drawbacks in some applications. First, there are certain applications for dynamoelectric machines that place these machines in environments having contaminants in the air to which the machine is exposed. For example, switches are utilized in motors which drive table saws or radial arm saws. When employed in a radial arm saw, the dynamoelectric machine is exposed to contaminants such as sawdust in the air. Often, these machines exposed to high concentrations of saw dust and other particles in the air are plagued by motor failure. Motor failure occurs because the electrical switch used in association with the open motor fails due to dust accumulation between the switch contact points.

As previously explained, the motors employed in the radial arm saws are either split-phase or capacitor start induction run motors that conventionally employ centrifugal actuators that control the operations of the starting circuit of the motor. When the motor is not running, the actuator closes the switch so that an auxiliary or start winding is connected to a source of electrical energy while the actuator disconnects the start winding as the motor reaches operating speed. Conventional switch structures of the prior art employed in this environment often malfunction because the contaminants that enter the switch and accumulate between the contact points do not allow the switch to close.

A number of attempts have been made in prior art to eliminate switch failure problems. In particular, attempts have been made to enclose the starting switch contacts in order to protect them from the environment. While this has reduced the failure rate of open motors used in the above applications, it has not completely solved the problem. For example, U.S. Pat. No. 4,414,443 to Gehrt, discloses an environmentally protected switch construction preventing foreign matter from affecting switch contact operation. However, the protective structure in this patent requires the use of a series of elements including a first washer, a soft, compressible washer inboard of the first washer, a third metallic washer positioned inboard of the pliable washer, and a spring positioned inboard of the third metallic washer, to create a suitable arrangement that protects the contacts from outside contaminates. This protective construction requires a plurality of parts, and is sensitive to alignment.

U.S. Pat. No. 4,922,066 to Crow et al., discloses an environmentally protected switch for dynamoelectric machines requiring the use of a metallic cap which surrounds the contact point affixed to the movable switch arm, a rubber-like boot affixed to the second contact post extending upward and interconnected with the metallic cap which surrounds the first contact point. As long as the boot adheres to the cap and the second contact post, the integrity of the enclosed environments for the switch contacts is maintained. However, since the integrity of the environment for the contact switch is dependant upon the alignment of the first metal cap and the rubber boot, as well as the alignment of the rubber boot on the second contact post, the metal cap and the rubber boot can become misaligned thereby destroying the integrity of the environmental seal. Even where misalignment is not a problem, the construction is relatively expensive to produce.

SUMMARY OF THE INVENTION

It is, therefore, an object of the present invention to provide an improved switch for dynamoelectric machines operating in contaminated environments such as a radial arm saw.

It is a further object of the present invention to provide a switch for use on a power tool having contact points completely enclosed by a single housing so as to protect the contact points from dust and debris.

It is another object of the invention to provide a switch having contact points completely enclosed so as to protect the outside environment from sparks.

It is a further object of the invention to provide a switch in which the contact points are housed in a single collapsible, resilient boot so that the movable contact point can be moved to the fixed contact point within the boot.

Yet another object of the invention is to provide a switch that is small, light-weight, durable, and reliable, utilizes a minimum of parts, is economical to manufacture, resistant to failure, and easily assembled and well suited for its intended purpose.

In accordance with this invention, generally stated, a dust-proof switch is provided for use with a dynamoelectric machine for application in a power tool such as a radial arm saw. The switch is intended for use with a centrifugal actuator which makes or breaks the switch contacts. A first contact of the switch is mounted on a resilient flexible switch arm. The switch arm is mounted at one end, and has a cantilevered second end extending across a terminal board which is caught between lips formed on a mounting boss to prevent rotation of the switch arm. The terminal board has a cup formed therein. A fixed contact point of the switch is contained within the cup. A compressible, flexible housing or boot is mounted snuggly on the cup and positioned between the terminal board. The boot extends upward to cover the first contact point and to abut the switch arm snuggly so that the boot completely encloses both contact points.

Movement of the actuator in one direction causes the arm to move in the direction of the terminal board and close the switch contacts. Movement of the actuator in a second direction causes the arm to move away from the board, opening the switch contacts. The contacts are mounted in alignment within the compressible boot during fabrication so when the flexible arm moves down toward the terminal board, the resilient boot collapses allowing direct positive contact between the contacts.

A stop is integrally formed on one end of the terminal board and is positioned above and controls flexible switch arm movement by limiting the upper most excursion of the switch arm and the contact point mounted thereon.

DESCRIPTION OF THE PREFERRED EMBODIMENT

Figure 1:
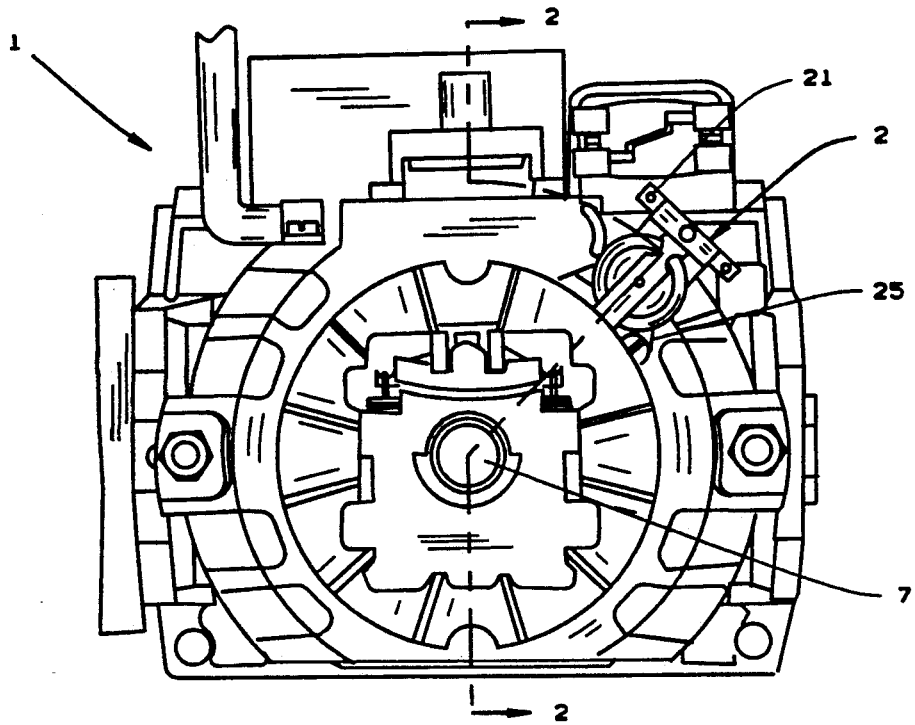
FIG. 1 is a front elevation, partly broken away, showing one illustrative embodiment of the present invention mounted within a dynamoelectric machine.
Figure 2:
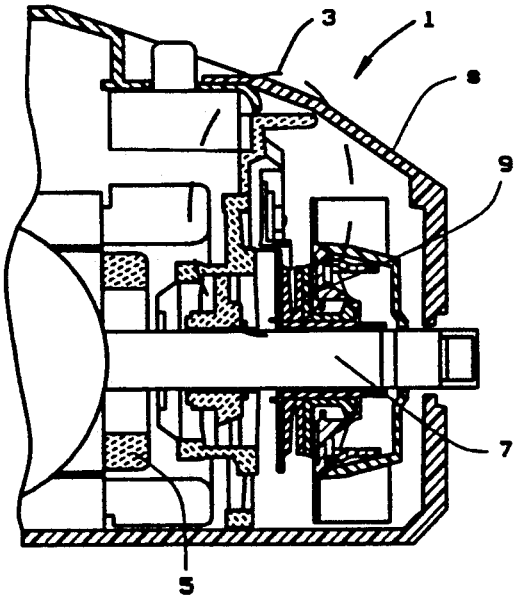
FIG. 2 is a side elevation, partly broken away and partly in section, taken along lines 2—2 of FIG. 1 showing one illustrative embodiment of the present invention mounted within a dynamoelectric machine.
Figure 3:
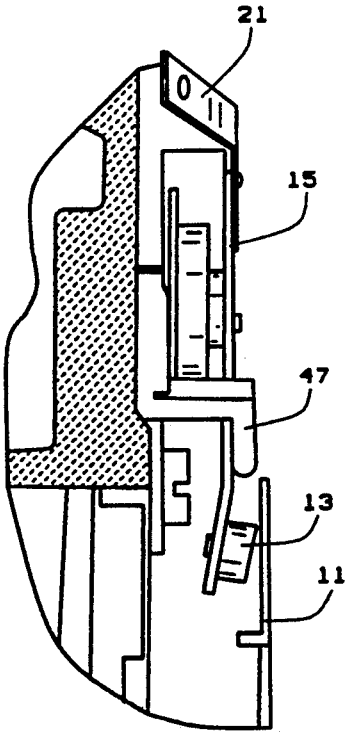
FIG. 3 is an enlarged partial section taken from FIG. 2 illustrating the relationship of the switch and its related centrifugal actuator.
Figure 4:
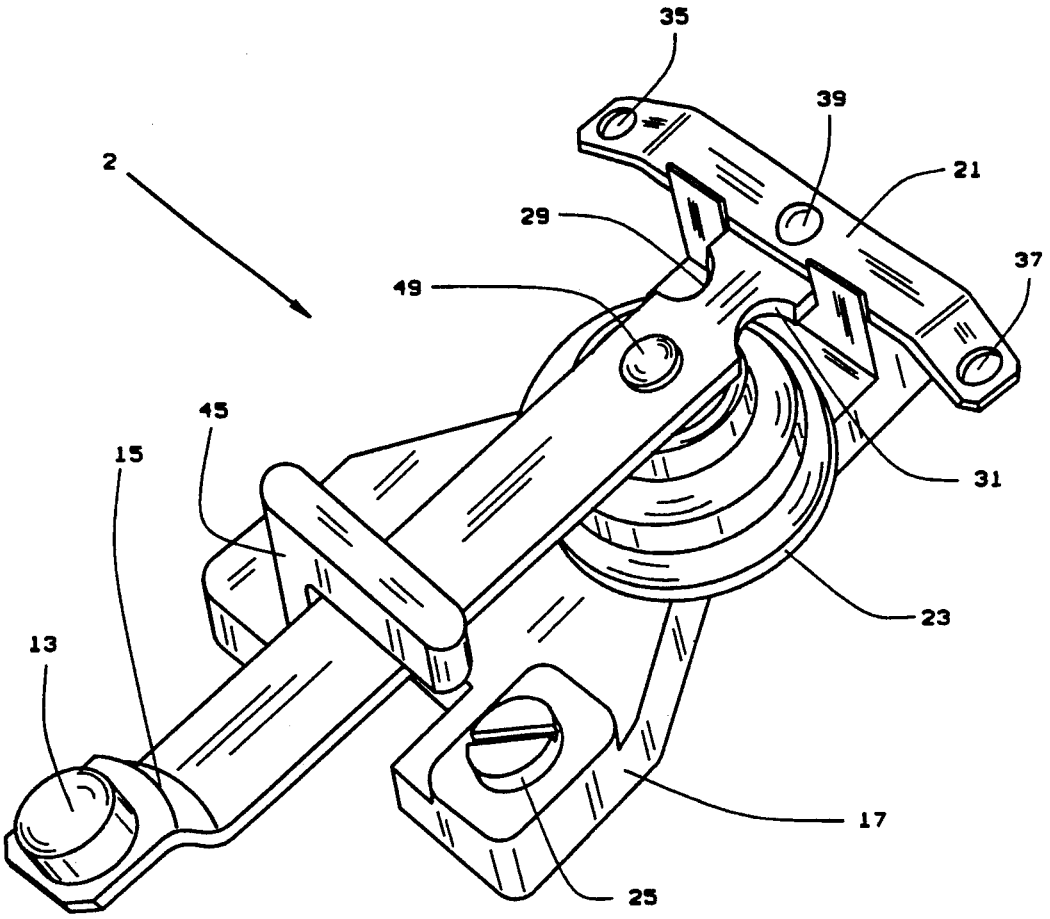
FIG. 4 is an enlarged perspective view of the switch assembly of the present invention.
Figure 5:
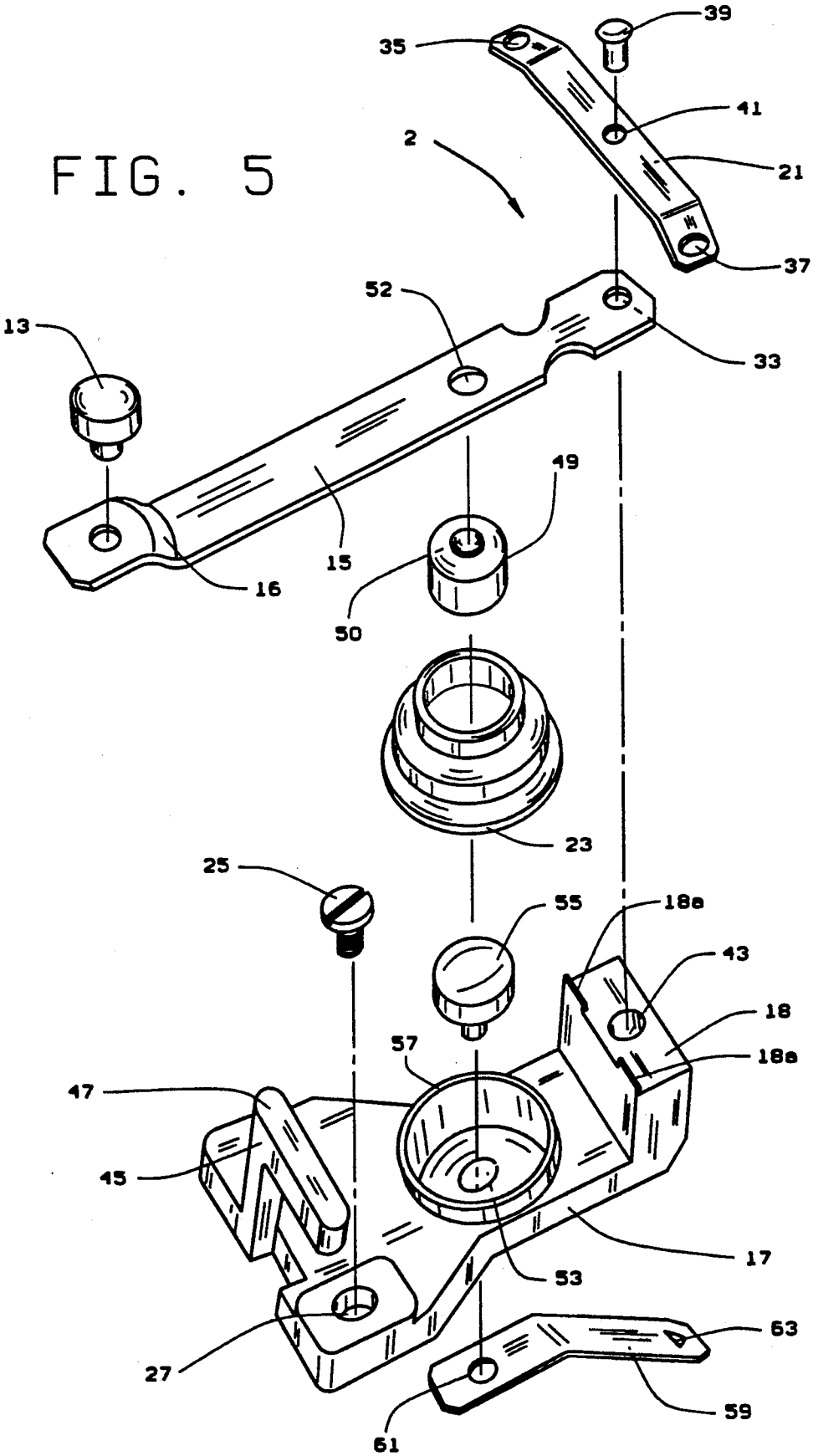
FIG. 5 is an enlarged exploded view of the switch assembly of the present invention.
Figure 6:
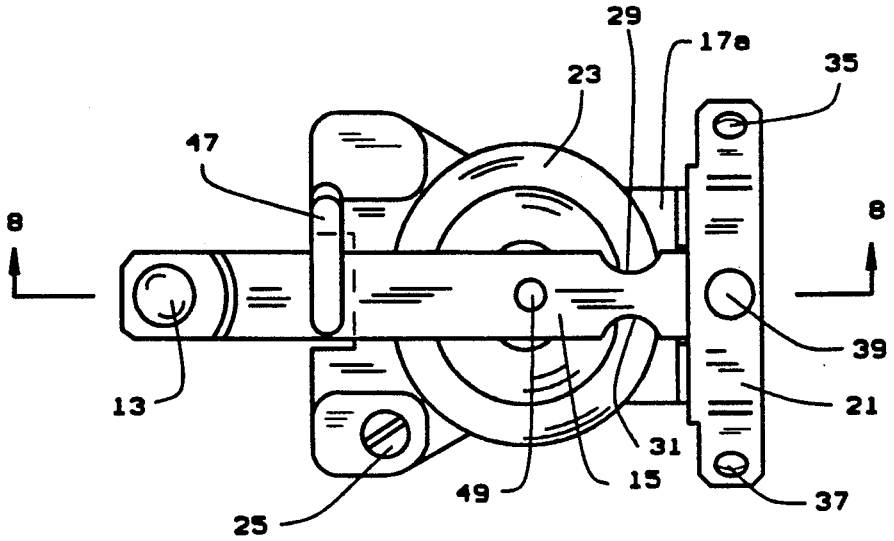
FIG. 6 is a top plan of the switch assembly of the present invention.
Figure 7:
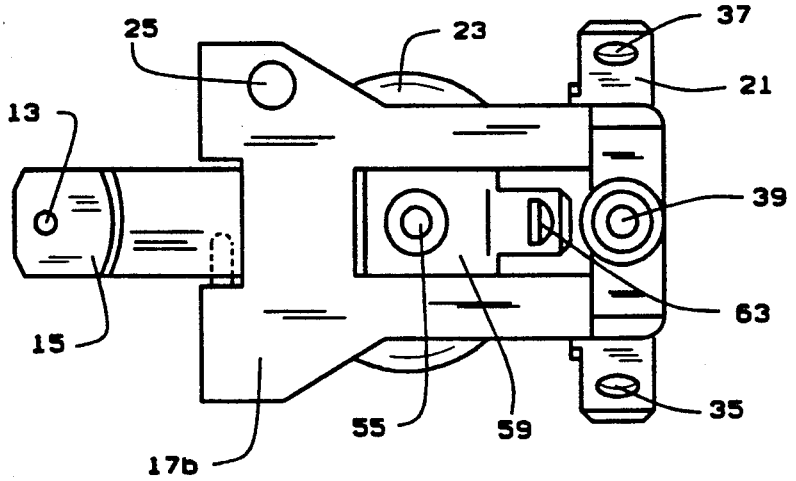
FIG. 7 is a bottom plan of the switch assembly of the present invention.

Referring now to FIG. 1 and FIG. 2 the reference numeral 1 indicates one illustrative dynamoelectric machine in the form of an induction motor assembly in which the present invention find application. Such a motor is intended to be used in a small appliance or power tool such as a radial arm saw. A switch assembly of the present invention is shown generally in FIG. 1 and FIG. 2 at 2, the motor assembly 1 contains a stator assembly 3 and rotor assembly 5. As well known in the art, rotor assembly 5 is mounted to shaft 7. Shaft 7 extends through at least one end of end shield S to provide mechanical output for the motor. A centrifugal actuator 9 is also mounted to shaft 7. The actuator 9 rotates with shaft 7. Attached to actuator 9 is a washer-shaped collar 11, as shown in FIG. 3, which has a central opening in it to permit the collar to fit over shaft 7. The collar moves axially along shaft 7 as centrifugal force causes a pair of weights (not shown) to move radially outward during rotation of rotor 5. When rotor 5 is stopped, collar 11 remains in contact with the free end pressure pad 13 of an electrically conductive switch arm 15. The switch arm 15 is fabricated from a conductive spring metal, and is described in greater detail hereinafter.

Turning now to a more detailed description of the switch assembly of the present invention as best illustrated in FIGS. 3–8, switch shown generally at 2 includes a terminal board 17. A switch arm 15, has a pressure pad 13 mounted to one end of it for the application of pressure by the centrifugal actuator collar 11, and is pivotally mounted at a second end of the terminal board 17. The arm 15 is cantilevered across the terminal board 17. Arm 15 also has a contact point 49 affixed generally centrally thereto. An electrical terminal strip 21 is electrically interconnected to the fixed end of arm 15. A protective boot 23 is situated between switch arm 15 and terminal board 17 to protect the contacts from external debris and dust and to retain any sparking therein as Will be explained hereinafter. The switch is easily installed within the motor through single mounting screw 25, as best illustrated in FIG. 1. This single mounting screw design allows the switch to be rotated about screw 25 to any suitable position within its environment. A pin 17*b* may be employed to help locate the switch in a desired location in applicational use. The switch 2 is installed with pressure pad 13 mounted cooperatively to the exterior so that the centrifugal actuator applied pressure operates the switch. A more detailed description of the components of switch 2 follows.

The relationship of the various components of switch 2 are best illustrated in FIGS. 4–8. Terminal board 17 provides a base for the arrangement and mounting of the various components of the switch. Terminal board 17 can be formed in any suitable shape or configuration so as to permit its mounting in operational relationship with the motor. Terminal board 17 is generally made of an appropriate material such as a glass-filled thermoplastic polyester. Terminal board 17 contains a mounting means for mounting the switch assembly within the motor, as previously described. Such means may include mounting screw as at 25 inserted through a mounting hole or bracket 27. Terminal board 17 has a boss 18 integrally formed thereon for mounting of switch arm 15 and the various components thereof. A pair of lips 18*a* are integrally formed on boss 18 and prevent rotation of switch arm 15. Other arrangements will occur to those skilled in the art.

Turning now to a more detailed description of the switch arm 15, and the various components contained thereon, switch arm 15 and the electrical terminal strip 21 cooperatively attached to one end are made from a suitable electrically conductive material such as copper or a beryllium-copper alloy. Arm 15 is flexible and resilient so that it can bend downward toward board 17 under pressure from the centrifugal actuator and also return to its original position after pressure release. Arm 15, has half moon cut-outs 29 and 31 formed therein which serve to increase the flexibility and biasing qualities of the arm and also serve to reduce the quantity of material required to manufacture the arm. Arm 15, at its free end, has raised off-set portion 16 forced in it. The second end of arm 15 has a hole 33 formed therein for mounting on a boss 18. The off-set or raised design of section 16 facilitates and improves the resiliency and biasing qualities of arm 15.

Electrical terminal strip 21 is designed for the attachment of circuit wires (not shown) for example, through connector openings 35 and 37 formed in strip 21. Arm 15 and terminal strip 21 are mounted to boss 18 by a suitable mounting means such as rivet 39 inserted down through an opening 41 and the opening 33 and an opening 43 in the switch arm 15 and terminal board 17 respectively, Since boss 18 is raised above the plane of terminal board 17, arm 15 is cantilevered across and is biased away from terminal board 17. Arm 15, as described above, is flexible and resilient so that it can be moved downward under pressure toward terminal board 17 and returned to its normal position upon release. Pressure pad 13 is affixed to its free end of arm 15 and positioned so as to abut the collar 11 of the centrifugal actuator when the acuator is applying pressure to arm 15.

Switch arm 15 is maintained in its proper alignment over terminal board 17 by lips 18*a* on boss 18 and by bracket 45 integrally formed on the other end of terminal board 17.

A first or movable switch contact point 49 has a concentric portion 50 which is inserted into hole 52 formed in switch arm 15 and is held in place by a snug, friction fit or other suitable means, such as by coining. Contact point 49 is made of a suitable metal such as copper or an alloy which is electrically conductive but also prevents the contacts from welding together under short circuit conditions. Such alloys can include tungsten-silver, tungsten-copper, tungsten-copper-nickel, silver graphite or silver-cadium.

Turning now to a more detailed description of the fixed contact and terminal components, switch board 17 has an opening 53 formed in it for receiving and seating a second or fixed switch contact point 55 as will be further explained. A cup 57 is integrally formed with and from the terminal board 17 material. Cup 57 surrounds opening 53 and extends upwardly from board 17. Cup 57 serves to mount a flexible boot as explained hereinafter.

Fixed switch contact 55, like switch contact 49, is made of a suitable electrically conductive material such as those previously described. Contact point 55 is electrically connected to interconnect terminal 59. Interconnect 59 permits the connection of the suitable contact 55 to the electrical circuit of its motor wire (not shown).

Figure 8:
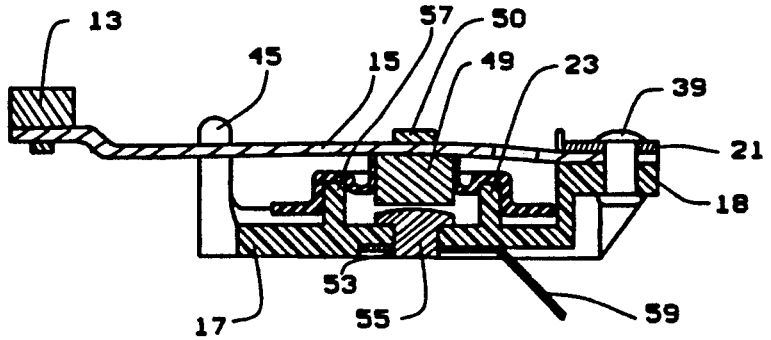
FIG. 8 is a sectional view of the present invention taken along lines 8—8 of FIG. 6.
Figure 9:
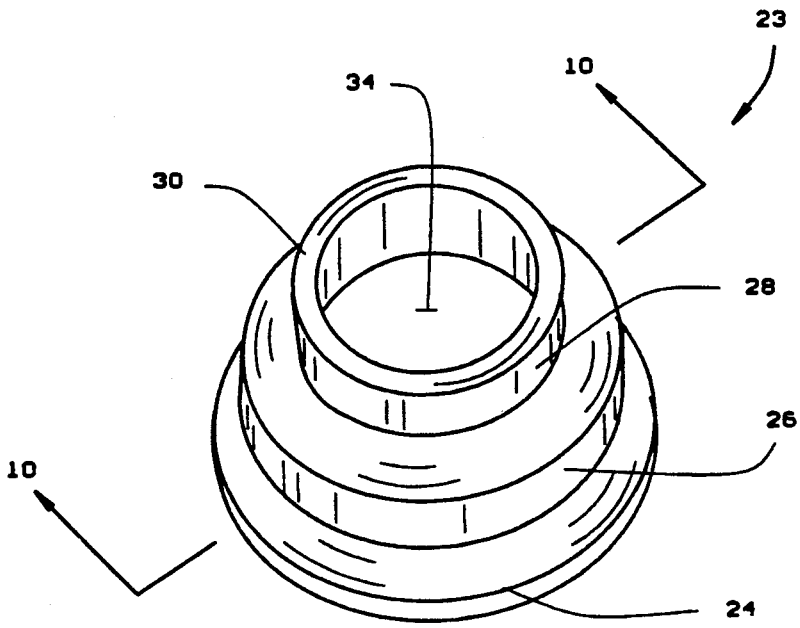
FIG. 9 is a perspective view of the boot component of the switch assembly of the present invention.
Figure 10:
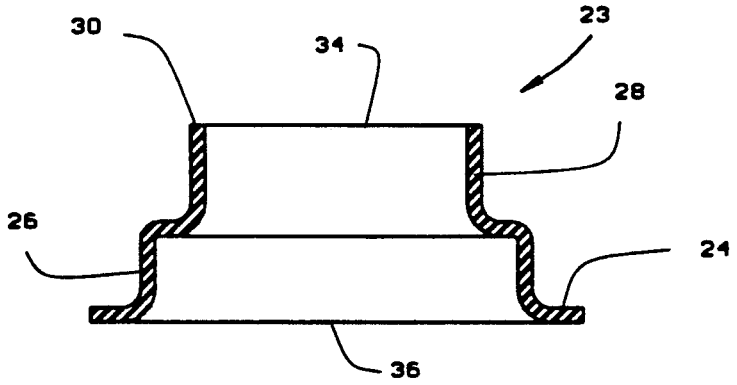
FIG. 10 is a section view of the boot component of the switch assembly of the present invention taken along lines 10—10 of FIG. 9.

Referring now to the electrical contact protective features of the switch, best illustrated in FIG. 8, an open-ended flexible resilient boot 23 is mounted on cup 57 and completely covers fixed switch contact 55 as well as the switch contact 49. As best illustrated in FIGS. 9 and 10, boot 23 is designed to completely cover both switch contacts. Boot 23 has top opening 34 and bottom opening 36 formed therein and is flexible and collapsible as well as resilient and is made from a non-conductive material such as rubber or neoprene. Boot 23 has a formed shape that defines a lower peripheral skirt 24 that fits flush against an upper surface of terminal board 17. A concentric wall 26 of boot 23 is designed so that its diameter completely surrounds cup 57 and fits over cup 57 is a snug, friction-fit. A second concentric wall 28 steps up from concentric wall 26 and is of such a diameter so as to surround switch contact 49 completely and yet allow movement of contact 49 therein. Upper surface 30 surrounding top opening 24, abuts the bottom side of arm 15 in a snug, air-tight fit. This configuration prevents the entry of dirt or debris into boot 23 and also serves to confine any sparks generated between contacts 49 and 55. Since boot 23 is flexible yet resilient, it can be compressed during activation of the switch to allow contact 49 to move toward and touch contact 55 thereby completing an electrical circuit. Upon release of the switch arm, as arm 15 returns to its original position parallel to board 17, resilient boot 23 will return generally to its predetermined shape.

Figure 11:
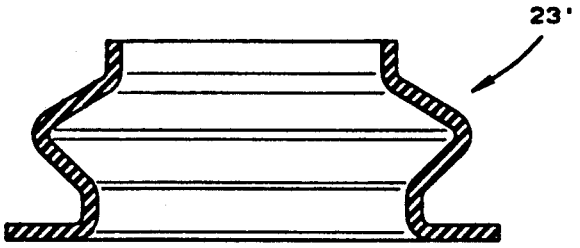
FIG. 11 is a section view of an alternate embodiment of the bottom component of the switch assembly of the present invention.

An alternative embodiment of the boot is shown at FIG. 11. As there shown, a bellows-type boot 23', when collapsed, provides spring force to open the switch contacts. By using the bellows-type boot 23', contact point pressure can be increased and the switch arm does not have to be a spring.

In operation, pressure is applied to switch arm pad 13 by centrifugal actuator collar 11 thereby forcing switch arm 15, with contact 49 affixed thereon, downward toward contact 55. Boot 23 is compressed so as to allow the movement of contact point 49 toward contact point 55 within boot 23. Contact between the two contact points closes the circuit and allows activation of the switch. When the centrifugal actuator backs off, allowing release of switch arm 15. The arm 15, due to its cantilevered mounting arrangement and resilient construction, returns to its original position moving contact 49 away from contact 55 breaking the electrical circuit. As arm 15 moves away from circuit board 17, resilient boot 23 returns to its preformed configuration thereby maintaining the integrity of the seal around the contact points. Stop 65 prevents excessive movement of arm 15 away from board 17 and the lips 18 keep arm 15 in proper alignment relative to board 17 and contact 55.

The foregoing description of the preferred embodiment is intended for illustrative purposes only and not to be construed in a limiting sense. In example, the terminal board 17 may be included in part of a larger electrical terminal board assembly. The predetermined configuration of the boot 23 may vary, while switch arm 15 was described as including certain cantilevered features, other embodiments of the invention may alter those features. These variations are merely illustrative.

What is claimed is:

1. A switch assembly for a dynamoelectric machine comprising:

a support means including an electrically non-conductive terminal board, said terminal board having a first side and a second side, said first side having a non-conductive cup formed therein;

a first electrical contact means mounted within said cup, said first electrical contact means including a connector means for connecting said first contact means to one of a source of electrical energy and said dynamoelectric machine;

an electrically conductive switch arm having a first end and a second end, means for attaching said switch arm to said terminal board at one end of said first and second ends, said attaching means holding said switch arm cantilevered above said terminal board and means for connecting said electrically conductive switch arm to an electrical terminal, said electrical terminal being electrically connected to the other of said source of electrical energy and said dynamoelectric machine;

a second electrical contact mounted to said conductive switch arm;

means for enclosing said first and second electrical contacts to isolate the contacts from the environment in which the machine operates, said enclosing means including a non-conductive resilient, flexible means, said flexible means including a pliable non-conductive boot having a first and second opening, one opening of said boot being sized to permit said boot to be in snug contact with said cup and the other opening of said boot being in contact with said electrically conductive switch arm, said first and second contacts being aligned within said boot and positioned to permit electrical connection with said contacts when an external force is applied to one of said contacts.

2. The switch assembly of claim 1 further comprising means for limiting travel of said switch arm in a direction away from said terminal board, said limiting means being integrally formed with said terminal board.

3. The switch assembly of claim 2 wherein said means for limiting travel of said conductive switch arm comprises a stop, said stop being integrally formed on one end of said terminal board, and rising up and over said terminal board.

4. The switch assembly of claim 1 wherein said conductive switch arm is constructed of flat spring material, said flat spring material having two half moon cut-outs formed therein so as to improve the spring-like qualities of said switch arm assembly.

5. The switch assembly of claim 1 wherein said switch arm is flat so that the material thickness of the arm exists in one plane.

6. The dynamoelectric machine adapted for use in an electric power tool, said dynamoelectric machine including a switch assembly, the improvement comprising:

an electrically non-conductive terminal board having a first end, a second end and a central portion having an electrically non-conductive cup formed therein;

a switch arm mounted to the first end of said terminal board;

a first switch contact point connected to said switch arm;

a second switch contact point mounted within said cup and positioned so as to touch said first switch contact point to form a closed circuit when external force is applied to said switch arm;

a flexible, electrically non-conductive boot mounted between said switch arm and said cup, said boot constructed so as to enclose said first and second contacts completely in all operational positions of said switches.

7. A switch assembly for a dynamoelectric machine comprising:

an electrically non-conductive terminal board having a first side and a second side, said first side having a non-conductive cup means integrally formed;

an electric terminal attached to said second side of said terminal board and positioned under said cup;

a first switch contact point mounted within said cup and electrically connected to said first terminal;

a cantilevered switch arm mounted to an end of said terminal board and extending above and across said terminal board, said switch arm being biased away from said first contact point, said switch arm having a second switch contact point formed thereon and positioned so as to touch said first contact when external force is applied to said switch arm; and, a compressible, resilient open-ended electrically non-conductive housing positioned over said cup means, said housing being positioned between said switch arm and said terminal board so as to abut said switch arm and enclose said first and second contact points when said contact points are touching and when said contact points are not touching.

8. The switch assembly of claim 7 wherein said switch arm further comprises a pressure pad, said pressure pad disposed so as to accept external force applied thereto.

9. A switch assembly for a dynamoelectric machine comprising:

an electrically non-conductive terminal board having a first side and a second side and a material thickness in between;

said first side having a non-conductive cup means formed thereon, said cup means including a sidewall defining a receptacle, a first electrical contact point having its bottom affixed within the receptacle defined by said cup;

an electrical terminal mounted on a second side of said terminal board and electrically connected to said first electrical contact point;

an electrically conductive, flexible switch arm having a fixed end attached to an of said first side of said terminal board and a free end cantilevered over and above said first side of said terminal board, said electrically conductive flexible switch arm having a second contact point thereon electrically connected to said switch arm, said switch arm also being electrically connected to a second terminal;

said first and second contacts being aligned with one another and positioned to permit electrical connection between said contacts when an external force is applied to said flexible switch arm;

a stop being integrally formed in one end of said terminal board, said stop rising above said arm and adapted to limit the travel of said arm away from said first side of said terminal board when no external force is applied to a free end of said arm to cause its movement away from said stop toward said terminal board;

a flexible, non-electrically conductive bellows-like boot having one end sized for and mounted snuggly about the sidewall of said cup means and enclosing said receptacle and said first contact point and an opposite end sized for enclosing said second contact point and desired to abut said flexible switch arm snuggly in all positions of said switch arm such that said boot completely encloses said first and said second contact points when said contact points are separated end when said contact points are in contact.

10. The switch of claim 9 wherein said first and second contact points are comprised of a material selected from the group containing tungsten-silver, tungsten-copper, tungsten-copper-nickel, silver-graphite, and silver-cadmium.

11. The switch of claim 9 further comprising means for preventing rotation of said switch arm.

12. The switch of claim 11 wherein said means for preventing rotation of said switch arm further includes a mounting boss, said mounting boss having stops formed thereon to prevent rotation of said switch arm.

13. The switch of claim 9 wherein said boot exerts a spring pressure on said switch arm.

14. The switch of claim 2 wherein said switch arm is flat so that the material thickness of the arm exists in one plane.

* * * * *